US006089164A

United States Patent [19]

Ostick

[11] Patent Number: 6,089,164

[45] Date of Patent: Jul. 18, 2000

[54] GANTRY SYSTEM

[75] Inventor: Colin Ostick, Port Coquitlam, Canada

[73] Assignee: Shell Oil Company, Houston, Tex.

[21] Appl. No.: 09/052,241

[22] Filed: Mar. 31, 1998

Related U.S. Application Data

[60] Provisional application No. 60/042,206, Mar. 31, 1997.

[51] Int. Cl.[7] ..... B61F 5/00

[52] U.S. Cl. ..... 105/163.1; 105/163.2

[58] Field of Search ..... 105/30, 148, 163.1, 105/163.2, 165, 169, 170

[56] References Cited

U.S. PATENT DOCUMENTS

| | | | |
|---|---|---|---|
| 3,866,484 | 2/1975 | Dreshman | 105/163.1 |
| 4,161,144 | 7/1979 | Raugulis et al. | 105/163.2 |
| 4,289,076 | 9/1981 | Miller | 105/163.2 |
| 4,358,020 | 11/1982 | Thiele | 105/163.1 |
| 4,360,112 | 11/1982 | Brewer et al. | 105/163.1 |
| 4,382,423 | 5/1983 | Kakehi et al. | 105/163.1 |
| 5,119,737 | 6/1992 | Thorsen | 105/163.2 |
| 5,609,190 | 3/1997 | Anderson et al. | 141/59 |
| 5,634,503 | 6/1997 | Musil et al. | 141/232 |

*Primary Examiner*—Mark T. Le

*Attorney, Agent, or Firm*—Del S. Christensen

[57] ABSTRACT

A gantry system is provided, the gantry system having a gantry cross member supported by at least two essentially parallel support beams supporting the cross member, the axis of movement of the cross member being essentially perpendicular to the at least two parallel support beams, at least two of the support beams each having a horizontal surface and a vertical surface, and at one point of along cross member, the cross member is operatively associated with one of the support beams through a fixed bogy and at another point, the cross member is operatively associated with another of the support beams through a spring bogy. The fixed bogy includes a frame supporting load carrying wheels vertically mounted and effective to roll along the horizontal surface of one of the support beams, and horizontal wheels are effective to roll along the vertical surface of one of the support beams. The spring bogy includes a frame supporting load carrying wheels vertically mounted and effective to roll along the horizontal surface of one of the support beams, and horizontal wheels effective to roll along the vertical surface of one of the support beams, wherein the vertical surfaces face opposite directions and the spring bogy horizontal wheels are urged toward the vertical surface on which it rolls.

6 Claims, 5 Drawing Sheets

GANTRY SYSTEM

A gantry in which the present invention can be advantageously incorporated in disclosed in, for example, U.S. patent application Ser. No. 08/461,276, filed on Jun. 5, 1995 now U.S. Pat. No. 5,634,503, incorporated herein by reference.

FIELD OF INVENTION

This invention relates to an apparatus for moving a payload from an overhead support system.

BACKGROUND TO THE INVENTION

Overhead gantry systems have been long known. Typically overhead cranes are suspended from such a gantry for use in large shops. Precision of movement, speed, and smoothness of movement for such cranes is typically not important. Robotic manipulators are also sometimes maneuvered by overhead gantry. Precision of movement is typically more important for robotic manipulators because movement to precise space coordinates is often required. Speed of such movement can also be important. In applications such as automated refuelling of vehicles, precision of movement and speed are important, and a gantry would also preferably have smooth movements. Further, cost of an apparatus such as a automated refuelling system is also critical. It is therefore desirable to provide a gantry wherein these goals are accomplished and a drive is required for movement along an axis on only one side of the gantry, and precision tracks are not required.

It is therefore an object of the present invention to provide a gantry system wherein alignment of tracks on which the gantry rides do not have to be precisely aligned. It is a further object to provide such a system wherein the gantry can be driven along an axis with only one drive motor, and fast, smooth and accurate movements can be made.

SUMMARY OF THE INVENTION

The objectives of the present invention are accomplished by providing a gantry system having a gantry cross member supported by at least two essentially parallel support beams supporting the cross member, the axis of movement of the cross member being essentially perpendicular to the at least two parallel support beams, at least two of the support beams each having a horizontal surface and a vertical surface, and at one point of along cross member, the cross member is operatively associated with one of the support beams through a fixed bogy and at another point, the cross member is operatively associated with another of the support beams through a spring bogy. The fixed bogy includes a frame supporting load carrying wheels vertically mounted and effective to roll along the horizontal surface of one of the support beams, and horizontal wheels are effective to roll along the vertical surface of one of the support beams. The spring bogy includes a frame supporting load carrying wheels vertically mounted and effective to roll along the horizontal surface of one of the support beams, and horizontal wheels effective to roll along the vertical surface of one of the support beams, wherein the vertical surfaces face opposite directions and the spring bogy horizontal wheels are urged toward the vertical surface on which it rolls. The horizontally mounted wheels on the spring bogy are preferably urged toward the vertical surface by springs which are mounted on the spring bogy, point laterally along the axis of movement of the gantry, and urge pivoting brackets outward, the pivoting brackets effective to translate the outward force to a force against the vertical surface of the support bracket.

This gantry can be supported on support beams which are not aligned perfectly either vertically, horizontally or parallel to each other by virtue of providing a spring bogy, the wheels of which follow the variation between a slave rail (within limits of spring controlled motion) and a central pivot on the spring bogy. This allows the spring bogy to follow vertical changes in slope of the slave rail with respect to the master rail. Further benefit is provided by the horizontal spring loaded wheels in that they allow deflection and momentary articulation of the bridge during acceleration of the payload when the center of gravity of the bridge and manipulator may fall on either side of the master rail thus preventing jamming and also allowing drive of the axis by a single drive belt. Consistent positioning of the payload with respect to the master rail is therefore achieved.

This gantry can be supported on support beams which are not machined to be true because of the resistance to binding provided by an allowance for movement provided by urging the horizontal wheels of the spring bogy toward the vertical surface. This gantry also provides smooth movement even if an unbalanced load is suspended from the gantry. More precise movements can also be provided for without the gantry being prone to binding.

DETAILED DESCRIPTION OF THE INVENTION

Figure 1:
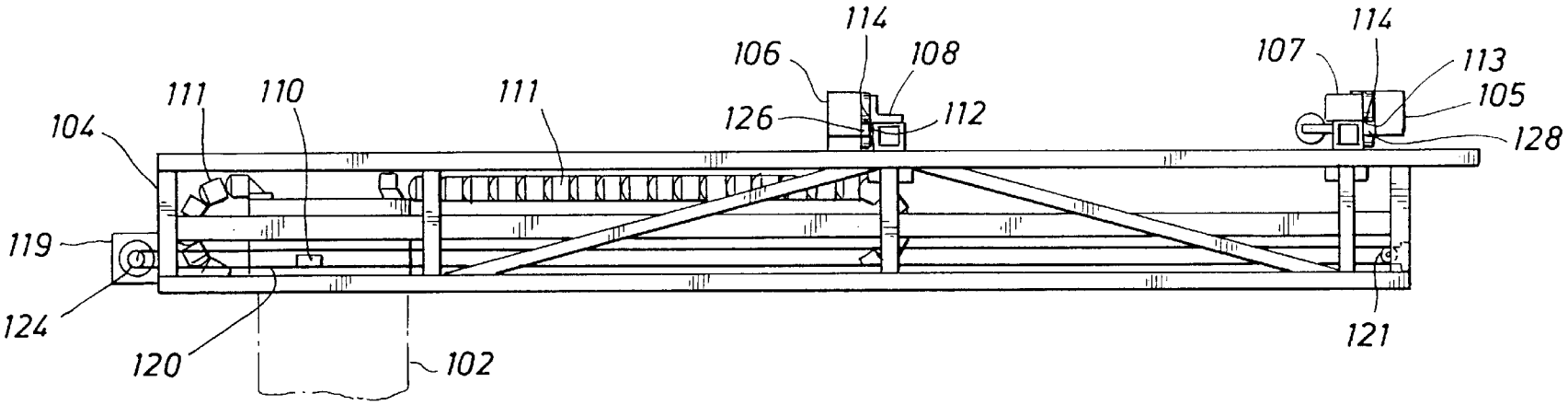
FIG. 1 shows a view of a gantry cross member according to the present invention.

Referring now to FIG. 1, the general arrangement of components of a gantry cross member utilizing the present invention is shown. A payload is suspended from a vertical arm 102. The cross member 104 extends laterally across and perpendicular to two support beams 105 and 106. A spring bogy 107 supports the cross member at one support beam, and a fixed bogy 108, supports the other end of the cross member. A longitudinal flexible track 111 is used to provide orderly placement of cables and conduits for operation of the payload along different positions of the cross member.

Movement of the payload along the length of the cross member is provided by a motor 119 which is engaged by a toothed sprocket 124 with a toothed belt 120. The toothed belt extends the length of the cross member to a free wheeling return sprocket 121. The toothed belt is attached to the payload at point 110 on one side of the toothed belt, but not the other. Thus, rotation of the toothed belt by the sprocket 124 moved the payload along the length of the cross member. Similarly, a lateral flexible track and toothed belt can be provided for maintaining conduits and cables orderly and move the cross member along the length of the support beams 105 and 106. The support beams have vertical surfaces 112 and 113 which oppose each other, and horizontal surfaces 114 on which vertical wheels ride to support the weight of the cross member and payload. These surfaces are shown on rails 126 and 128 attached to the support beams.

Figure 2C:
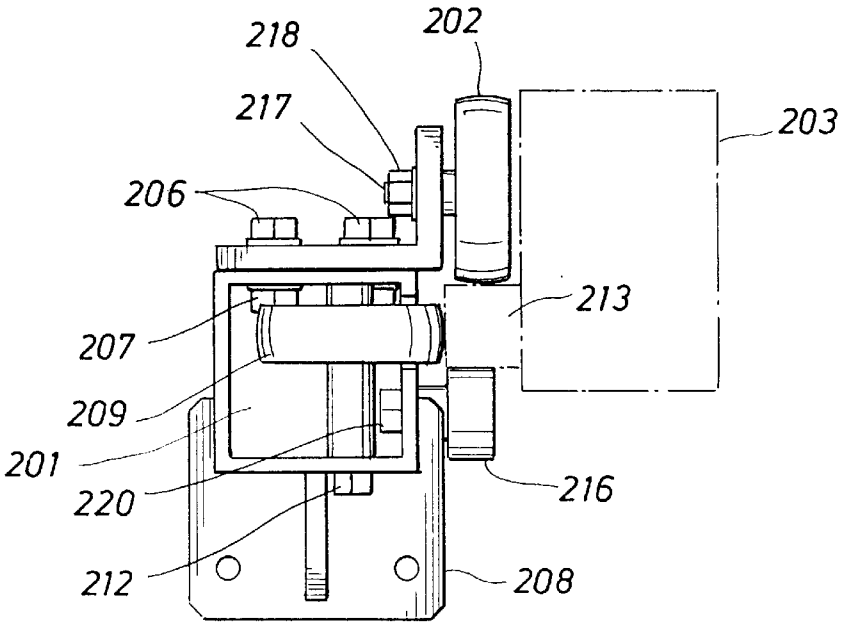
FIGS. 2A through 2C show three views of a fixed bogy of the present invention.
Figure 2A:
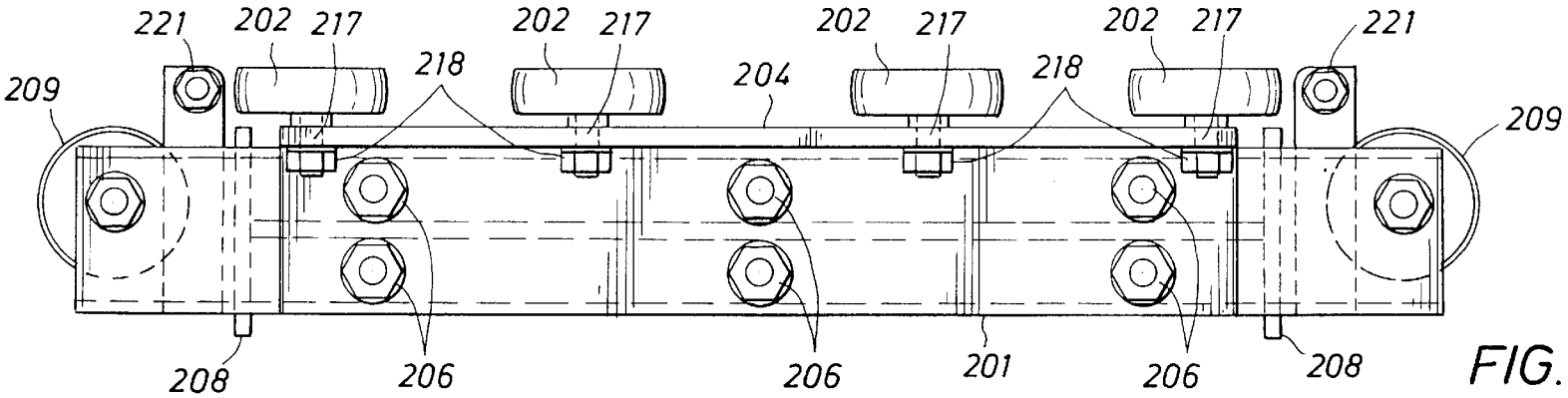
Figure 2B:
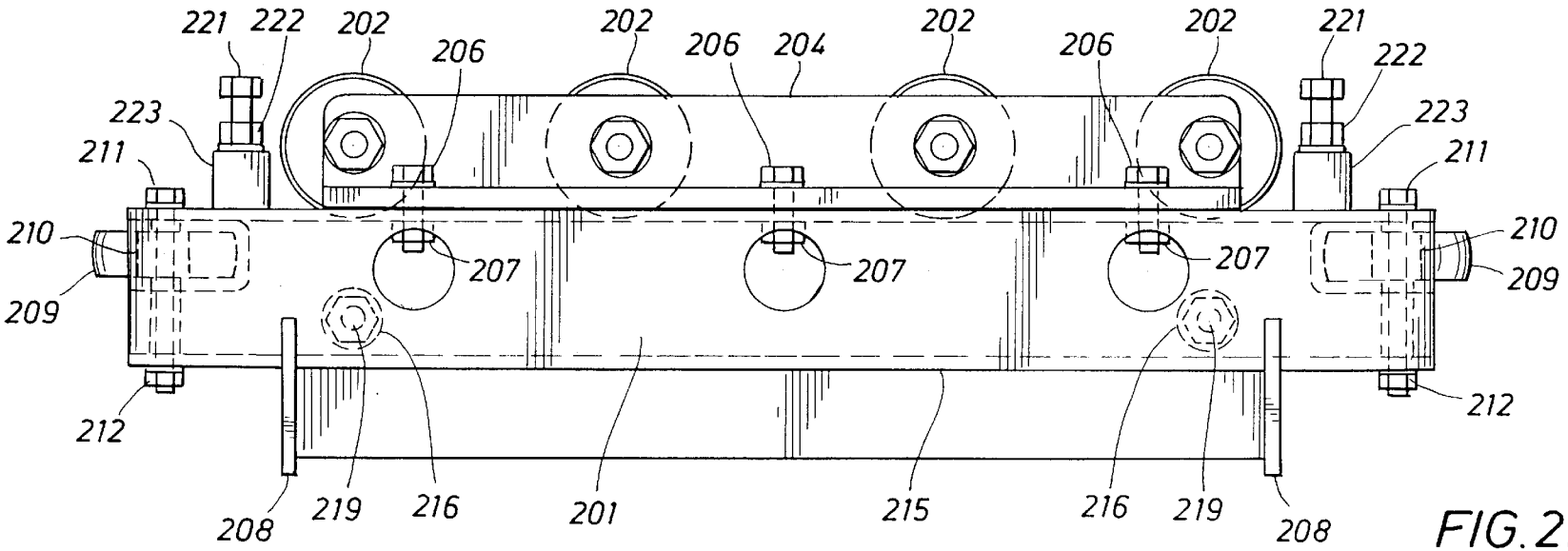

Referring now to FIGS. 2A through 2C, three views are shown of a fixed bogy useful in the present invention. The fixed bogy 201 has four weight supporting vertical wheels 202 which are effective to support the bogy on a rail 213, the rail attached to support beam 203 (shown in broken lines). The vertical wheels are mounted on axles 217 secured by nuts 218. Each of the load bearing wheels are mounted with roller bearings on an axle which are mounted on an angle bracket 204, which is attached to a frame 205 by bolts 206 and nuts 207. Brackets 208 are provided to attach the fixed bogy to the cross member. Horizontal wheels 209 are shown in a fixed position relative to the frame of the fixed bogy and mounted on the frame of the fixed bogy through bearings 210 and axles 211 (shown as bolts mounted with nuts 212). Lower vertical wheels 216, mounted on axles 219 and secured by nuts 220, help keep the fixed bogy aligned with the rail.

Jack screws 221 are threaded into nuts 222 which are welded on sleeves 223 to provide a means to lift weight off the weight supporting wheels in order to perform maintenance on the fixed bogy assembly.

Figure 3A:
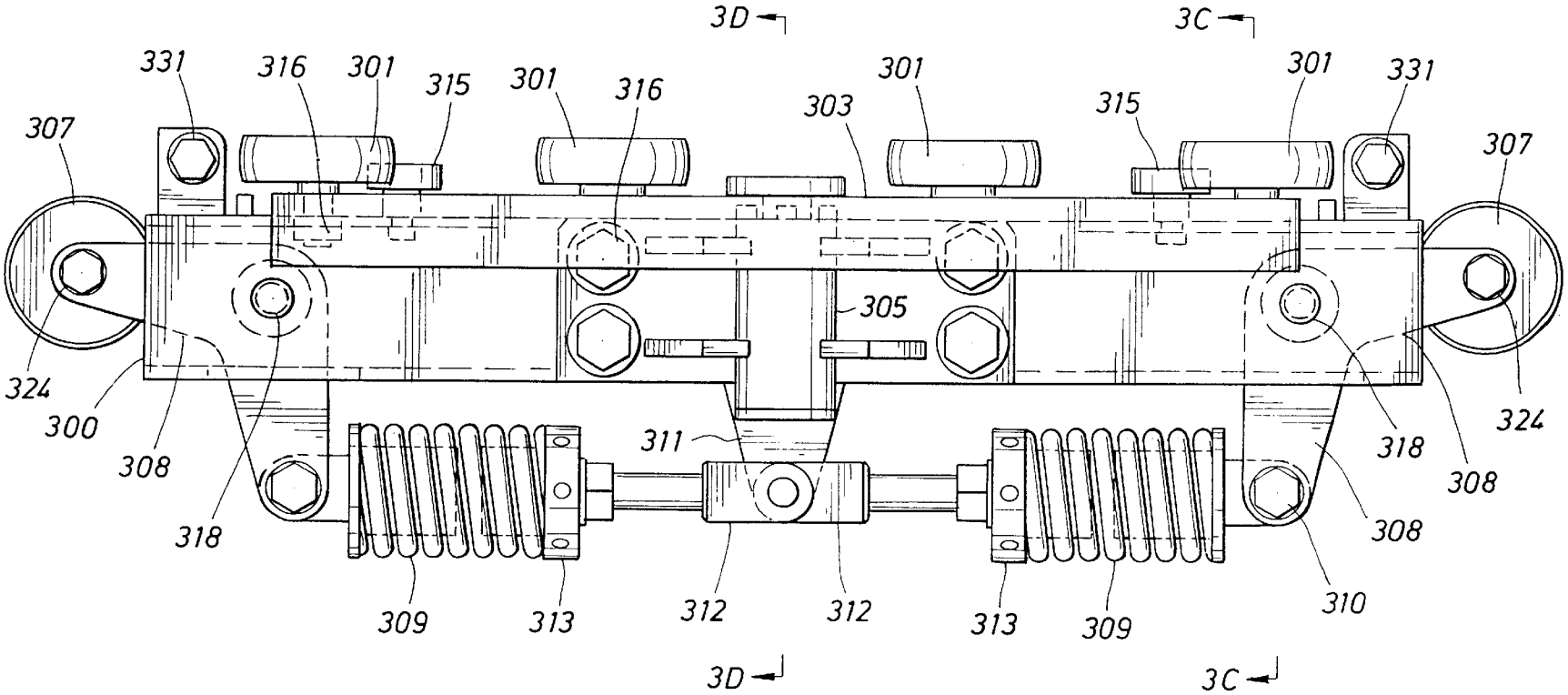
FIGS. 3A through 3D show four views of a spring bogy of the present invention.
Figure 3B:
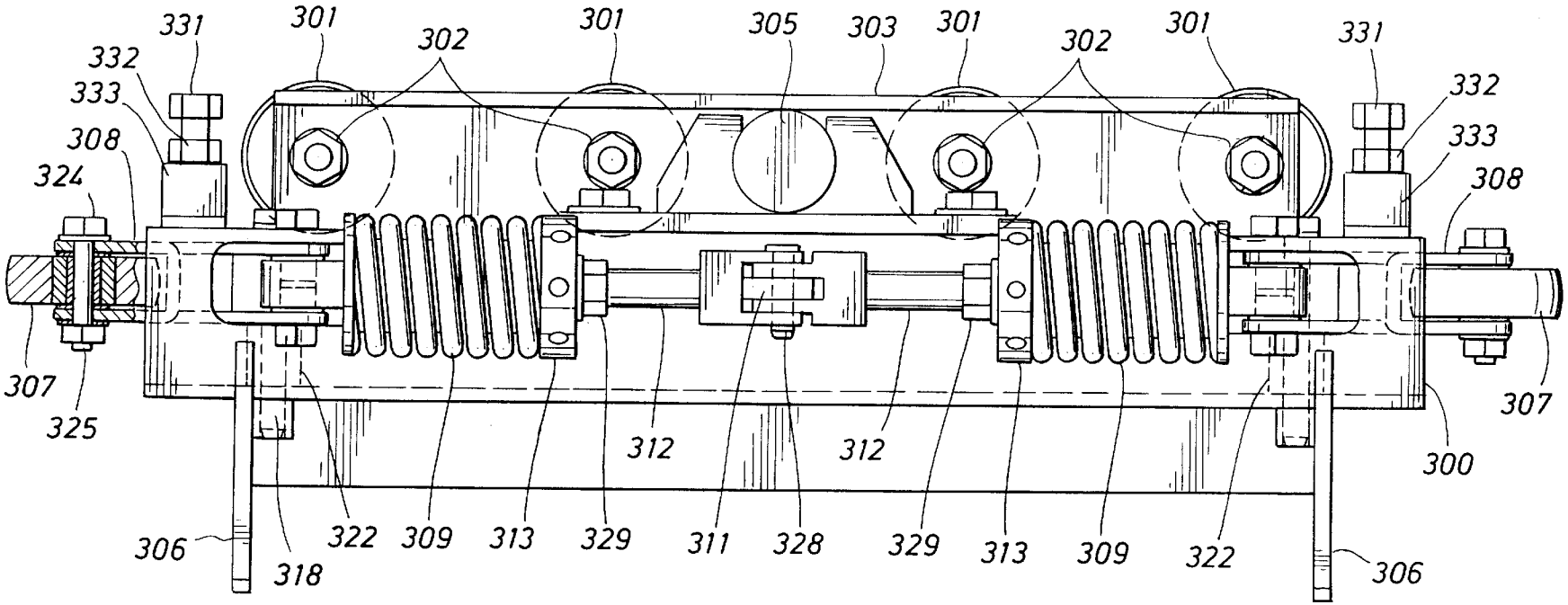
Figure 3D:
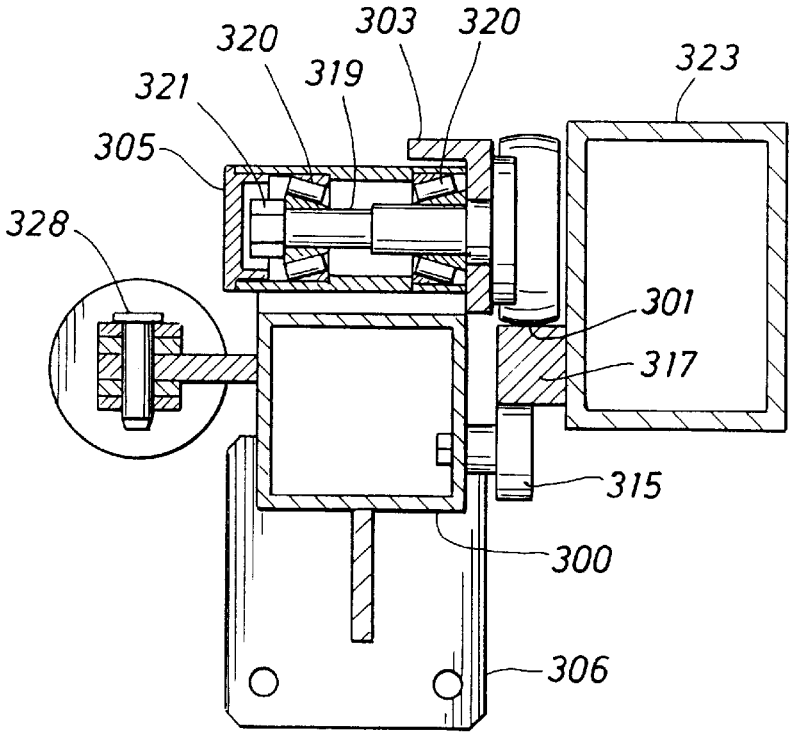
Figure 3C:
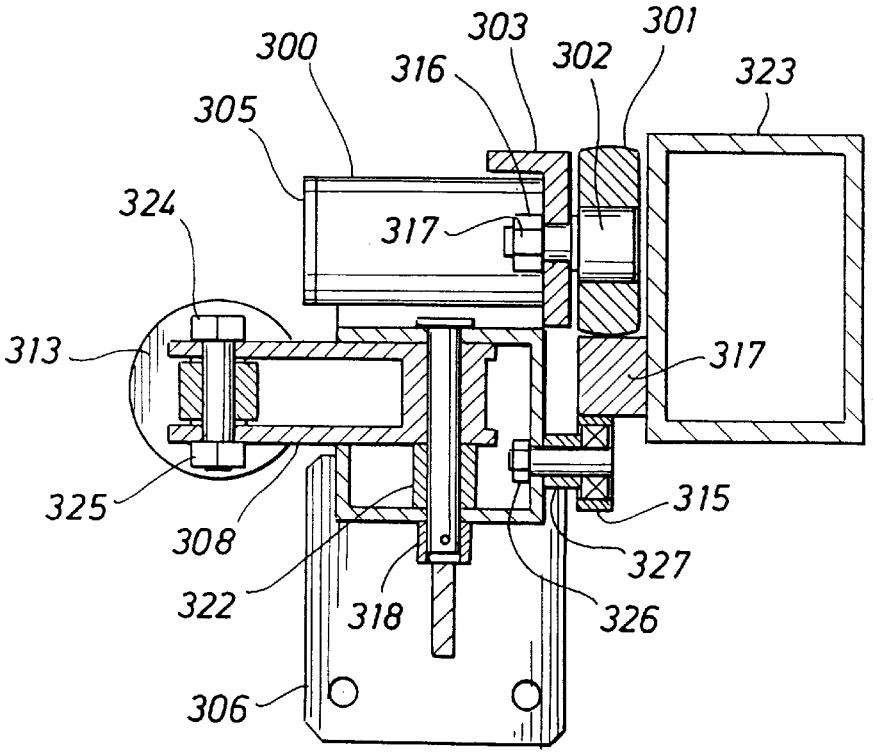

Referring now to FIGS. 3A through 3D, four views of a spring bogy 300 are shown. FIG. 3C is view A—A, and FIG. 3D is view B—B, of FIG. 3A. Vertical wheels 301 (four shown) are mounted by roller bearings 302, axles 317, secured by nuts 316, on a vertical wheel frame 303. The vertical wheel frame is shown pivotally mounted to a spring bogy frame 304 by a pivot bearing housing 305 with axle 319, roller bearings 320 and locknut 321. Brackets 306 to support a cross member (not shown) extend from the spring bogy frame.

Two horizontally mounted wheels 307 are rotatably mounted on pivot brackets 308. The pivot brackets are mounted on axles 318 secured by nuts 325. Springs 309 urge the pivot brackets outward, with the pivot brackets translating the outward force to a force essentially laterally, against vertical surfaces of the rail. Spring end connectors 310 pivotally connect the springs to the pivot brackets by way of pivot pin 328. Spring bracket 311 is mounted to the spring bogy frame and provides a mounting point for two threaded clevis rods 312. Spring compression is provided by rotation of adjusting nuts 329, on which spring compression cups 313 rest. Each horizontal wheel assembly pivots about pivot pin 318 in response to variations in width between the two vertical surfaces of the two vertical surfaces of the rails 317, the rails supported on support beam 323. Pivot brackets 308 are aligned on the pivot pin by spacers 322. Some radial movement of the spring is provided by the spring bracket and the adjustable spring brackets being attached by a vertical pin 328 around which the springs can rotate. Lower vertical wheels 315 are shown mounted to fit under a horizontal surface in order to keep the spring bogy aligned with the support beam. The lower vertical wheels are preferably plastic coated wheels, and are mounted on axles 327 and secured by nuts 326.

The spring bogy and the fixed bogy are secured to a cross member so that vertical surfaces of the rails on which the horizonal wheels of each ride against, 317 and 213, oppose each other. These surfaces preferably face each other, but they could face toward the outside of the apparatus, and the bogys could be placed on the outside of the support beams.

Jack screws 331 are threaded into nuts 332 which are welded on sleeves 333 to provide a means to lift weight off the weight supporting wheels in order to perform maintenance on the fixed bogy assembly.

The number of horizontal and vertical wheels can be varied. Providing more wheels decreases the forces on each wheel and can decrease the size and strength of bearings and wheels required. A plurality of wheels is preferred in order to limit the force on each wheel, and permit use of plastic coated wheels.

Other arrangements to urge the horizontal wheels of the spring bogy toward a vertical surface of the support beams can be provided, and the particular method shown is not critical. For example, the spring bogy can be long enough so that springs can directly urge the horizontal wheels toward the vertical surface of the support beam.

By providing a rotating pivot that allows the spring bogy to accommodate differences between the horizontal surfaces on which the spring bogy rides and on which the fixed bogy rides, the horizontal surfaces need to be aligned can be aligned much less accurately. Providing a springs to urge the horizontal wheels toward the vertical surfaces results in the vertical surfaces needing to be installed with much less accuracy. Further, use of the spring bogy accommodates temporary misalignment caused by acceleration of the cross member when the cross member is driven from a single belt drive, and when the center of gravity of the cross member is asymmetric.

A preferred payload in the practice of the present invention is an end-effector for an automotive refuelling system is described in U.S. patent application Ser. No. 08/461,281, filed on Jun. 5, 1995, incorporated herein by reference.

The preceding description of the present invention is exemplary, and reference is made to the following claims to determine the full scope of the present invention.

We claim:

1. A gantry system, the gantry system comprising:

a gantry cross member, the cross member being movable along an axis of movement; and at least two essentially parallel support beams supporting the cross member, the axis of movement of the cross member being essentially perpendicular to the at least two parallel support beams, at least two of the support beams each having a horizontal surface and a vertical surface, and at one point of along cross member, the cross member is supported by one of the support beams through a fixed bogy and at another point, the cross member is supported by another of the support beams through a spring bogy wherein a payload is supported and movable along the cross member, wherein the fixed bogy includes a frame supporting load carrying wheels vertically mounted and effective to roll along the horizontal surface of one of the support beams, and horizontal wheels are effective to roll along the vertical surface of one of the support beams; and a single drive to move the crossmembers along the support beams, and the spring bogy includes a frame supporting load carrying wheels vertically mounted and effective to roll along the horizontal surface of one of the support beams, and horizontal wheels effective to roll along the vertical surface of one of the support beams, wherein the vertical surfaces face opposite directions and the spring bogy further comprises a spring mechanism effective to urge the horizontal wheels toward the vertical surface on which it rolls.

2. The gantry system of claim 1 wherein the spring bogy further comprises a pivoting connection that allows the cross member to pivot with respect to the support beam along an axis that is essentially parallel to the axis of a line between the spring bogy and the fixed bogy.

3. The gantry system of claim 1 wherein the fixed bogy further comprises a pivoting connection that allows the cross member to pivot with respect to the support beam along an axis that is essentially parallel to a line between the spring bogy and the fixed bogy.

4. The gantry system of claim 1 wherein the two vertical surfaces face each other.

5. The gantry system of claim 4 wherein the spring mechanism includes springs.

6. The gantry system of claim 5 wherein the horizontal wheels are urged outward through a pivoting connection, the pivoting connection effective to translate force in a direction essentially along the axis of movement of the cross member to a direction that is essentially normal to the vertical surfaces.

* * * * *